US006202768B1

(12) United States Patent
Lindgren et al.

(10) Patent No.: US 6,202,768 B1
(45) Date of Patent: Mar. 20, 2001

(54) ROCK DRILLING TOOL AND REAMER FOR PERCUSSIVE DRILLING

(75) Inventors: Daniel Lindgren; Per-Olof Liljebrand, both of Sandviken; Håkan Lindström, Torsåker, all of (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/274,325

(22) Filed: Mar. 23, 1999

(30) Foreign Application Priority Data

Mar. 23, 1998 (SE) ..... 9800969

(51) Int. Cl.[7] ..... E21B 10/40

(52) U.S. Cl. ..... 175/389; 175/385; 175/389; 175/392; 175/397; 175/399; 175/406; 175/407; 175/414; 175/415

(58) Field of Search ..... 175/389

(56) References Cited

U.S. PATENT DOCUMENTS

| | | | | |
|---|---|---|---|---|
| 1,515,819 | | 11/1924 | Zublin . | |
| 4,275,796 | | 6/1981 | Kleine . | |
| 4,408,669 | * | 10/1983 | Wiredal | 175/258 |
| 4,545,443 | * | 10/1985 | Wiredal | 175/258 |

* cited by examiner

*Primary Examiner*—Roger Schoeppel
(74) *Attorney, Agent, or Firm*—Burns, Doane, Swecker & Mathis, L.L.P.

(57) ABSTRACT

A rock drilling tool includes a pilot bit screw threaded into a front end of a drill rod. A reamer is mounted on the outside of the pilot bit. The reamer includes a central opening having a front portion and a rear portion. The front portion is connected to the pilot bit, and the rear portion constitutes a stiffening sleeve which extends around the outside of the drill rod.

13 Claims, 2 Drawing Sheets

ROCK DRILLING TOOL AND REAMER FOR PERCUSSIVE DRILLING

FIELD OF THE INVENTION

The present invention relates to a rock drilling tool for percussive drilling, said rock drilling tool comprising a pilot bit having a first thread at one end, a rod for percussive drilling which at one end is provided with a second thread intended to cooperate with said first thread, and a reamer disposed around the pilot bit. The reamer is, at one axial end, provided with rock cutting means. The invention further relates to a reamer for percussive drilling.

PRIOR ART

To achieve reamed cut holes there are previously known rock drilling tools of the above-described type, such as that described in Kleine U.S. Pat. No. 4,275,796, wherein the drill bit has a pilot bit intended to guide the rock drilling tool in the preferably predrilled pilot hole. In some embodiments of a rock drilling tool of the known type, the pilot bit can be provided with a rock cutting means, for example in the form of a chisel. The pilot bit has a male thread, which is connected to a female thread of a rod for percussive drilling. A reamer is disposed around the pilot bit and connected with the same by means of a thread or a conical connection. Known rock drilling tools of this type have the drawback of frequently breaking in the threaded connection between the pilot bit and the rod, more exactly in the area of the shoulder abutment of the threaded joint. The reason therefor is that the relatively great radial dimension of the reamer mounted on the pilot bit causes large bending stresses in said threaded joint, which results in the above-mentioned breakage in the threaded connection.

OBJECTS AND SUMMARY OF THE INVENTION

A primary object of the present invention is to provide a rock drilling tool of the above-described type, which is more rigid and consequently has a better ability to handle the bending loads during tool performance, where said bending stresses are not transferred, in any great extent, to the threaded connection between the pilot bit and the rod for percussive drilling.

Another object of the present invention is to design the reamer in such a manner that the risk for entrance of drill cuttings into the threaded connection between the pilot bit and rod for percussive drilling is diminished.

The objects of the invention are realized by a drilling tool comprising a drill rod, a pilot bit, and a reamer. The drill rod includes a front portion having an outer cylindrical surface of uniform diameter. The pilot bit is threadedly mounted at a front end of the drill rod by a screw thread connection and projects longitudinally forwardly beyond the drill rod. The reamer surrounds the pilot bit and includes rock cutting structure at a forward end of the reamer. The reamer includes a rearwardly extending stiffening sleeve which extends along the uniform-diameter front portion of the outer surface of the drill rod for a portion of the drill thread connection.

The invention also pertains to a reamer adapted for use on a percussion rock drilling tool. The reamer comprises a body having a front end carrying a rock cutting structure. The body includes a central opening having a front portion for engaging a pilot bit, and a rear stiffening portion for engaging a drill rod. A smallest diameter of the central opening in the rear stiffening portion is larger than a smallest diameter of the front portion of the central opening.

DESCRIPTION OF THE DRAWINGS

The objects and advantages of the invention will become apparent from the following detailed description of a preferred embodiment thereof in connection with the accompanying drawing in which like numerals designate like elements, and in which.

DETAILED DESCRIPTION OF THE PREFERRED EMBODIMENTS

Figure 1:
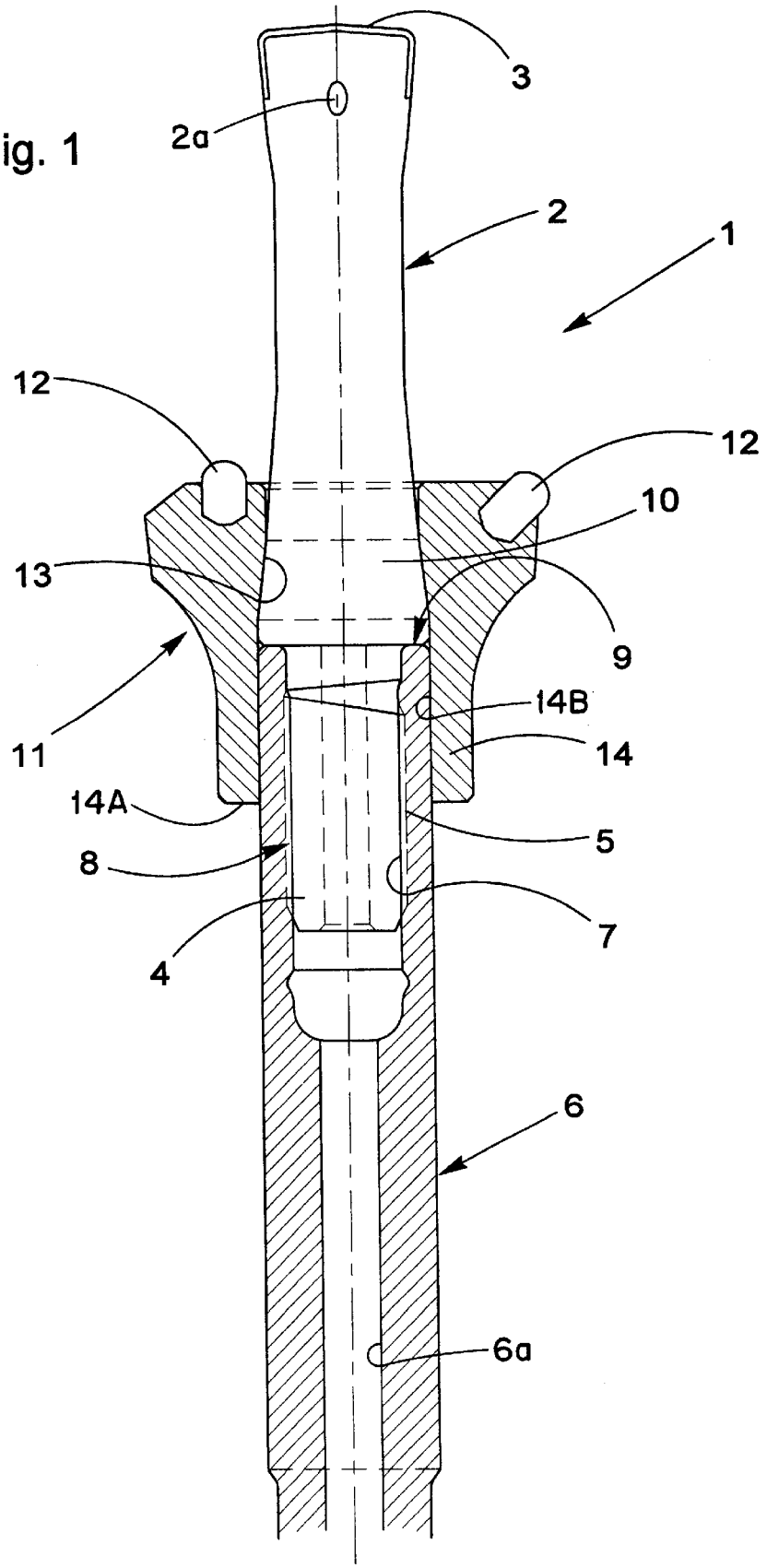
FIG. 1 shows a partly sectioned side view of a first embodiment of a rock drilling tool according to the present invention.

The rock drilling tool shown in FIG. 1 comprises a pilot bit 2, which in the shown embodiment is provided at a forward end thereof with rock cutting means in the form of a chisel 3. At the opposite rear end the pilot bit 2 has a threaded tap 4, which is provided with a male thread 5. The pilot bit 2 has a passage 2*a* extending therethrough for conducting a flushing medium which is ejected through an opening 2*a* located via the chisel 3.

The rock drilling tool 1 according to the present invention also comprises a rod 6 for percussive drilling, depicted as a drill rod. The drill rod 6 is provided with a female thread 7 at one end, which is intended to cooperate with the male thread 5 for forming a threaded joint 8 for percussive drilling. In the shown embodiment the threaded joint has a shoulder abutment 9, formed by a forwardly facing surface of the drill rod and a rearwardly facing surface of the pilot bit, for the transfer of shock waves from the drill rod 6 to the pilot bit 2.

At the opposite end of the drill rod (not shown), the drill rod 2 can have an additional thread (not shown) for connection with an additional drill rod (not shown), or alternatively the drill rod 2 can be provided with a neck (not shown) to be received by a shank adapter (not shown) of a machine for percussive drilling (not shown). The rod 6 is hollow to form a center passage 6*a* for conducting flushing medium.

In an axially intermediate section thereof, the pilot bit 2 is provided with an external, forwardly tapering conical portion 10, which is intended to cooperate with a reamer 11 seated upon the pilot bit 2. The reamer is provided with rock cutting structure 12 at its forward end, which in the shown embodiment comprises drill bit buttons. To be able to be mounted around the pilot bit 2, the substantially symmetrical reamer 11 is provided with a central opening. That opening includes an internal conical portion 13, which in a mounted condition of the reamer 11 circumferentially around the pilot bit 2, cooperates with the external conical portion 10 of the pilot bit 2, whereby a conical joint is achieved for mounting the reamer 11 in operative position on the pilot bit 2. When mounting the reamer 11 on the pilot bit 2, the reamer 11 is pushed onto the pilot bit 2 in a rearward direction from the forward chisel end of the pilot bit 2. Thereby said conical portions 10 and 13 come into engagement with each other and the reamer 11 is mounted in its operative position on the pilot bit 2. The axial forces acting on the reamer 11 during drilling, i.e. in a rearward direction from the chisel 3 of the pilot bit towards the reamer 11, cause the engagement between the conical portions 10 and 13 to become tighter, whereby a steady conical joint is achieved between the reamer 11 and the pilot bit 2.

According to the invention the reamer 11 has an axially extending stiffening portion 14, extending in a rearward direction away from the buttons 12, which in the shown embodiment has the general shape of a cylinder. A section 14B of the central opening extends through the stiffening portion and is of circular-cylindrical shape. A minimum diameter of the section 14B is larger than a minimum diameter of the conical surface 13. The stiffening portion 14 axially overlaps the threaded connection 8. The diameter of the section 14B of the central opening is selected such that the stiffening portion 14 surrounds the threaded connection 8 and more specifically surrounds the external surface of the drill rod 2, in the area of said threaded joint 8, with a fit which includes a radial gap between the drill rod and the stiffening portion 14 that is bigger than 0 mm and up to 1.5 mm. The external surface of the drill rod 2, in the area of said threaded joint 8 is not reduced by means of undercuts or recesses, thereby maintaining maximum strength. That is, the external surface of the drill rod in the area of joint 8 is of constant diameter. The diameter of the rod 6 in the external area cooperating with the reamer 11 is substantially equal to the diameter of a portion of the rod contiguous to said area, i.e., a portion extending rearwardly from the reamer. That is, the rod 6 is not provided with external strength-reducing undercuts or recesses. This also means that the rear end surface 14A of the reamer is completely free from engagement with the rod. In the shown embodiment the stiffening portion 14 has an axial extension which terminates at about the axial midpoint of the threaded joint 8. In relation to the total axial extension of the reamer 11, the stiffening portion 14 has an axial extension which constitutes at least one half of said total axial extension of the reamer.

A preferred use of the rock drilling tool 1 according to the present invention will now be described. The rock drilling tool 1 is intended to ream an already existing pilot hole, which normally is drilled with a standard drill bit. Upon initial engagement of the drilling tool 1 against a rock surface to achieve reamed blasting holes, the pilot bit 2 will extend into a predrilled pilot hole, and the reamer 11 will abut against the rock surface to be machined. When a feed force is applied on the rock drilling tool 1, the pilot bit 2 will guide the rock drilling tool 1, via the pilot hole, while the reamer 11 reams the pilot hole to a diameter which in principle corresponds to the diameter of the reamer 11. Thereby, the rock machining in the reamed hole will be performed by the buttons 12, of which some are positioned at the periphery of the reamer 11, see FIG. 1. The reamed hole achieves a somewhat varying diameter depending on the wear of the gauge buttons 12, said diameter normally being somewhat bigger than the external diameter of the reamer body. Bending stresses will be transferred to the threaded connection 8 between the pilot bit 2 and the drill rod 6, since the resistance with which the machined rock surface exerts on the buttons of the reamer 11 varies along the front surface of the reamer 11. These bending stresses will, to a major extent, be transferred to the drill rod 6 via the stiffening portion 14 of the reamer 11. That results in the threaded connection 8 being exposed to lower bending stresses than in the case of known similar rock drilling tools, provided that the fit between the internal circular-cylindrical surface of the stiffening portion 14 and the external circular-cylindrical surface of the part of the drill rod 2 which is enclosed by the stiffening portion 14 has a gap in the radial direction which is within the above-indicated interval, i.e. the gap is bigger than 0 mm, but not bigger than 1.5 mm.

In the final step of the reaming operation, the pilot bit 2 reaches the bottom of the predrilled pilot hole. The chisel 3 of the pilot bit 2 thereby elongates the pilot hole somewhat such that the reaming can continue to the end of the predrilled pilot hole. An advantage of having the rear end surface of the reamer free of contact with the drill rod is that impact waves will not reflect back into the rod.

Figure 2:
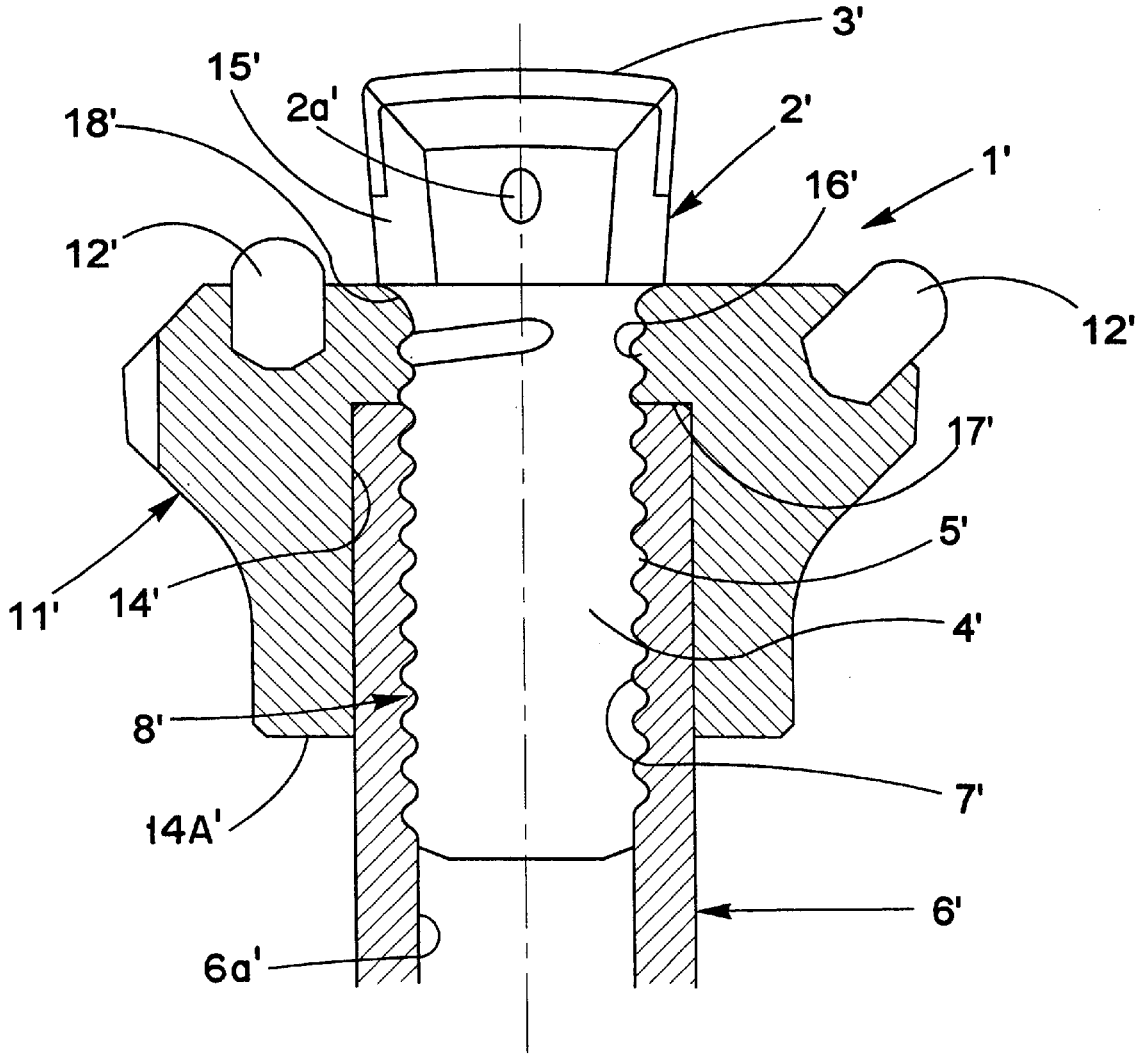
FIG. 2 shows a partly sectioned side view of a second embodiment of a rock drilling tool according to the present invention.

An alternative embodiment of a rock drilling tool according to the present invention shown in FIG. 2 has a pilot bit 2', which at a forward end is provided with rock cutting means in the form of a chisel 3'. A shaft 4' of the pilot bit 2' connects to a chisel-carrying head 15' of the pilot bit 2'. The shaft 4' is provided with an external thread 5'. A discharge opening 2*a*' for flushing fluid is located near the chisel 3'.

The rock drilling tool 1' also comprises a drill rod 6', which is provided with an internal female thread 7'. The female thread 7' and the male thread 5' form a threaded joint 8' when the pilot bit 2' and the drill rod 6' are mounted such as shown in FIG. 2. The end surface (not shown) of the drill rod 6' can be formed in different ways as described above in connection with the embodiment according to FIG. 1.

A reamer 11' is mounted on the pilot bit 2', between the head 15' and the threaded connection 8'. The reamer 11' has, like the reamer 11 according to FIG. 1, rock cutting structure in the form of drill bit buttons 12'. Some of these buttons 12' are provided at the periphery of the reamer 11'. The reamer 11' according to FIG. 2 is provided with an internal thread 16' extending along a part of the total axial extension of a central opening of the reamer 11'. The internal thread 16' is positioned in the part of the reamer 11' which in the mounted position of the reamer 11', see FIG. 2, is disposed immediately behind the head 15' of the pilot bit 2'. The reamer 11' furthermore has an internal stiffening portion 14', which in the shown embodiment includes an internal circular-cylindrical surface that has an axial extension, which constitutes a part of the total axial extension of the central opening through the reamer 11'. The stiffening portion 14' is situated an end of the part of the reamer 11' that is opposite the end thereof that carries the buttons 12'. Also in this embodiment the rear end surface 14A' of the reamer is completely free from engagement with the rod. The cylindrical surface 14' has a minimum diameter that is larger than a minimum diameter of the thread 16'.

As is evident from FIG. 2, the sum of the axial extension of the internal thread 16' and the axial extension of the stiffening portion 14' is equal to the total axial extension of the reamer 11'. The internal thread 16' and the stiffening portion 14' are interconnected by a radially extending ledge 17'. In the shown embodiment the axial extension of the stiffening portion 14' constitutes at least the half of the total axial extension of the reamer 11'.

To mount the rock drilling tool 11' according to FIG. 2 the internal thread 16' of the reamer 11' is first threaded onto the external thread 5' of the shaft 4' of the pilot bit 2', said threading continuing until the front surface of the reamer 11', carrying the buttons 12', comes into abutment against a shoulder 18' interconnecting the shank 4' and the head 15'. Then the internal female thread 7' of the drill rod 2' is threaded onto the male thread 5' of the shank 4' until the free end of the drill rod 2' comes into abutment against the ledge 17'. The stiffening portion 14' thereby surrounds a certain, axially extending part of the threaded connection 8', wherein the axial extension of the stiffening portion 14' constitutes at least one half of the external axial extension of the thread 5' between the shoulder 18' and the free end of the shank 4'. It is important, just like in the embodiment according to FIG. 1, that the stiffening portion 14' fits on the cooperating part of the external surface of the drill rod 2, in a manner forming a radial gap which is bigger than 0 mm and up to 1.5 mm, in order for the stiffening to be efficient.

Since the threaded connection 8' normally is heavily tightened during a drilling operation, there is no risk of the reamer 11' moving axially relative to the shank 4' of the pilot bit 2'. The abutment between the free end of the drill rod 2' and the ledge 17' is thus maintained during operation, which guarantees a good cooperation between the stiffening portion 14' and the external surface of the drill rod 2' positioned internally thereof.

The rock drilling tool 1' according to FIG. 2 functions in principally the same manner as the rock drilling tool 1 according to FIG. 1, and what has been said above in that respect applies here as well. It should be noted that specific for the rock drilling tool 1' according to FIG. 2, the function of stiffening is enhanced by the cooperation between the ledge 17' and the free end of the drill rod 2'. In addition, it will be very difficult for drill cuttings to enter into to the threaded connection 8' even if there occurs a vacuum in the radial gap between the drill rod 6,6' and the reamer 11, 11', since the stiffening portion 14' together with the ledge 17' form a kind of maze (i.e., a serpentine interface) for resisting an influx of drill cuttings.

In each embodiment of the invention, radial the gap formed between the drill rod 6; 6' and the reamer 11; 11' facilitates mounting of the reamer 11; 11' on the drill rod 6; 6'. During operation, an additional pressure exists in the rock drilling tool 1; 1' relative to the surroundings, wherein said additional pressure is created by the supplied flush medium through the passage 6*a*; 6*a'*. Said additional pressure efficiently prevents entrance of drill cuttings between the drill rod 6; 6' and the reamer 11; 11' during operation.

CONCEIVABLE MODIFICATIONS OF THE INVENTION

In each of the above described embodiments of the rock drilling tool 1; 1' according to the present invention, the pilot bit 2; 2' is provided with an external male thread while the drill rod 6; 6' is provided with an internal female thread. However, it can, within the limits of the invention, be possible to provide the pilot bit with an internal female thread and the drill rod with an external male thread.

In the drilling tool 1; 1' according to the present invention, the threaded connection 8; 8' is provided with a shoulder abutment 9; 17'. Within the limits of the invention it is conceivable that the threaded connection instead could have a bottom abutment or a combination of shoulder- and -bottom abutment.

The pilot bit 2; 2' in the above shown embodiments is provided with rock cutting means in the form of a chisel. Within the limits of the invention it is, however, possible for the pilot bit to be provided with other types of rock cutting means, for example drill bit buttons. There are also rock drilling tools of the current type where the pilot bit is not provided with rock cutting means. Such types of rock drilling tools are also included in the scope of the present invention. For that reason the expression "pilot bit" is interpreted to cover also cases when the pilot bit is not provided with rock cutting means.

The reamer 11; 11' according to the above described embodiments is provided with rock cutting structure in shape of drill bit buttons. Within the limits of the invention it is conceivable that the reamer could have other types of rock cutting means, for example chisels.

In general, the type of rock cutting means of the pilot bit and of the reamer can be combined in a number of different ways, wherein it is also possible that different types of rock cutting means could be provided on the pilot bit. The same is true also for the reamer.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A percussive rock drilling tool comprising a drill rod, a pilot bit, and a reamer;

the drill rod including a front portion having a first screw thread;

the pilot bit having a second screw thread threadedly mounted to the first screw thread to form therewith a screw thread connection, the pilot bit projecting longitudinally forwardly beyond the drill rod;

the reamer surrounding the pilot bit and including a front portion carrying rock cutting structure, the reamer including an opening through which the pilot bit projects and a rearwardly extending stiffening sleeve integral with the front portion, the stiffening sleeve extending along an outer surface of the drill rod for a portion of the screw thread connection.

2. The percussive rod drilling tool according to claim 1 wherein an outer diameter of a portion of said rod extending rearwardly from said stiffening sleeve is equal to an outer diameter of a portion of said rod surrounded by said stiffening sleeve.

3. The percussive rock drilling tool according to claim 2 wherein there is a radial gap between the outer surface of the drill rod and an inner surface of the stiffening sleeve, the gap being greater than zero and no greater than 1.5 mm.

4. The percussive rock drilling tool according to claim 1 wherein there is a radial gap between the outer surface of the drill rod and an inner surface of the stiffening sleeve, the gap being greater than zero and no greater than 1.5 mm.

5. The percussive rock drilling tool according to claim 3 wherein the drill rod and the pilot bit include central passages for conducting flushing fluid to a discharge opening formed in the pilot bit adjacent a forward end thereof.

6. The percussive rock drilling tool according to claim 1 wherein the central opening has an internal conical surface, and the pilot bit includes an external conical surface engaged by the conical surface of the reamer.

7. The percussive rock drilling tool according to claim 1 wherein the reamer is mounted on the pilot bit by an additional screw-threaded connection, the additional screw connection disposed forwardly of a front end of the drill rod.

8. The percussive rock drilling tool according to claim 7 wherein the reamer includes a rearwardly projecting radial ledge abutting against the front end of the rod.

9. The percussive rock drilling tool according to claim 1 wherein the rod and the pilot bit include respective central fluid conducting passages for conducting flushing fluid toward a discharge opening disposed in the pilot bit adjacent a front end thereof.

10. The percussive rock drilling tool according to claim 1 wherein the first screw thread comprises a female screw thread, and the second screw thread comprises a male screw thread.

11. A reamer adapted for use on a percussive rock drilling tool, comprising a body having a front end carrying a rock cutting structure, the body including a central opening having a front portion for engaging a pilot bit, and a rear stiffening portion for engaging a drill rod, a smallest diameter of the central opening in the rear portion being larger than a smallest diameter of the front portion of the central opening, wherein the front portion of the central opening has an internal screw thread, and the rear portion is circular cylindrical.

12. The reamer according to claim 11 wherein the reamer includes a rearwardly facing radial ledge interconnecting the front and rear portions of the central opening.

13. A reamer adapted for use on a percussive rock drilling tool, comprising a body having a front end carrying a rock cutting structure, the body including a central opening having a front portion for engaging a pilot bit, and a rear stiffening portion for engaging a drill rod, the front portion of the central opening being conical and tapering in a forward direction, and the rear portion being circular cylindrical, a smallest diameter of the cylindrical rear portion being larger than a smallest diameter of the conical front portion.

* * * * *